US011296462B2

(12) United States Patent
Schneider et al.

(10) Patent No.: US 11,296,462 B2
(45) Date of Patent: Apr. 5, 2022

(54) CONNECTOR ASSEMBLY WITH A CONNECTOR POSITION ASSURANCE INDICATOR

(71) Applicant: Aptiv Technologies Limited, St. Michael (BB)

(72) Inventors: John D. Schneider, Warren, OH (US); Rangarajan Sundarakrishnamachari, Royapettah (IN); Velmurugan Kandasamy, Salem (IN)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/028,223

(22) Filed: Sep. 22, 2020

(65) Prior Publication Data

US 2021/0111519 A1 Apr. 15, 2021

Related U.S. Application Data

(60) Provisional application No. 62/913,320, filed on Oct. 10, 2019.

(51) Int. Cl.

| | |
|---|---|
| ***H01R 13/641*** | (2006.01) |
| ***H01R 13/627*** | (2006.01) |
| ***H01R 43/26*** | (2006.01) |

(52) U.S. Cl.

CPC ..... *H01R 13/641* (2013.01); *H01R 13/6275* (2013.01); *H01R 43/26* (2013.01)

(58) Field of Classification Search

CPC ..... H01R 13/465; H01R 13/641; H01R 13/6272; H01R 13/6275; H01R 43/26

(Continued)

(56) References Cited

U.S. PATENT DOCUMENTS 5,203,718 A * 4/1993 Chishima ..... H01R 13/641 439/350
9,583,860 B1 * 2/2017 DeWitte ..... H01R 13/62955

(Continued)

FOREIGN PATENT DOCUMENTS

| | | |
|---|---|---|
| DE | 10143266 A1 | 4/2003 |
| EP | 2993740 B1 | 3/2018 |
| JP | 2006351275 A | 12/2006 |

OTHER PUBLICATIONS

European Search Report dated Feb. 9, 2021. 10 pages.

*Primary Examiner* — Gary F Paumen
(74) *Attorney, Agent, or Firm* — RMCK Law Group PLC

(57) ABSTRACT

A connector comprises a connector body having a mating interface configured to engage a complementary mating connector, a first indicator feature carried by the connector body, the first indicator feature having a first partial visual identifier disposed thereon, and a second indicator feature carried by the connector body having a second partial visual identifier disposed thereon, wherein the first and second indicator features are movable relative to each other between a separated position and a joined position, characterized in that the first and second indicator feature form a complete visual identifier only when in the joined position, wherein the first and second indicator features are in the separated position when the connector body is not fully mated relative to the mating connector, and wherein the first and second indicator features are in the joined position responsive to the connector body being fully mated to the mating connector.

20 Claims, 8 Drawing Sheets

(58) Field of Classification Search
USPC ..... 439/488, 489, 491, 352
See application file for complete search history.

(56) References Cited

U.S. PATENT DOCUMENTS

| | | | | |
|---|---|---|---|---|
| 10,355,414 | B1 | 7/2019 | Alvarado | |
| 10,431,933 | B2 | 10/2019 | Gibeau | |
| 10,651,586 | B2 * | 5/2020 | Christiano | H01R 13/641 |
| 2008/0133047 | A1 * | 6/2008 | Best | H01R 13/465<br>700/215 |
| 2015/0318640 | A1 | 11/2015 | Gibeau | |
| 2017/0102423 | A1 * | 4/2017 | Maalouf | H01R 13/641 |
| 2017/0229813 | A1 * | 8/2017 | Exenberger | H01R 13/62977 |

* cited by examiner

CONNECTOR ASSEMBLY WITH A CONNECTOR POSITION ASSURANCE INDICATOR

CROSS-REFERENCE TO RELATED APPLICATION(S)

The present application claims the benefit of U.S. Provisional Application No. 62/913,320, filed on Oct. 10, 2019. The disclosure of the above-identified application is incorporated herein by reference in its entirety.

FIELD

The present disclosure generally relates to a connector assembly with a connector position assurance device, particularly a connector assembly with a connector position assurance indicator.

BACKGROUND

Automotive Original Equipment Manufacturers (OEMs) require methods to ensure that an electrical connector with wires is properly connected with a mating connector. To ensure the connection system is mated, a connector position assurance device (CPA) that is moveable from a pre-stage position to a staged position only when the connector and mating connector are fully seated is provided to ensure the proper mating of the connector. However, assembly operators may mate the connectors but fail to move the CPA to the proper seated position, thereby failing to assure that the connector is properly connected with the mating connector. In order to address this problem, OEMs are requiring a way to verify that the CPA is closed after the connection system is mated.

Some connector assemblies include a recordable feature that is used to record and log a presence, position, characteristic, or other features of the connector assembly during a manufacturing process or an assembly process that verifies proper mating of the connector assembly. It may be useful to record that the connector assembly is properly mated to verify that such a connection has been made in the assembly process and/or to verify the presence of the connector assembly in a larger product that is being assembled, such as an automobile or an appliance. Such data may then be stored in a database.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

According to one aspect of the present disclosure, a connector is presented. In one exemplary implementation, the connector comprises: a connector body having a mating interface configured to engage a complementary mating connector during a mating operation, a first indicator feature carried by the connector body, the first indicator feature having a first partial visual identifier disposed thereon, and a second indicator feature carried by the connector body having a second partial visual identifier disposed thereon, wherein the first and second indicator features are movable relative to each other between a separated position and a joined position, characterized in that the first and second indicator feature form a complete visual identifier selected from a list consisting of a one-dimensional barcode, a two-dimensional barcode, and a three-dimensional barcode only when in the joined position, wherein the first and second indicator features are in the separated position when the connector body is not fully mated relative to the mating connector, and wherein the first and second indicator features are in the joined position responsive to the connector body being fully mated to the mating connector.

In some implementations, the complete visual identifier identifies the connector, the complete visual identifier being machine-readable such that the complete visual identifier is able to be read by a sensor only when the first and second indicator features are in the joined position. In some implementations, a wall of the connector body defines the first indicator feature, the first partial visual identifier is disposed on an outer surface of the wall, the second indicator feature being a connector position assurance (CPA) device on which the second partial visual identifier is disposed that is coupled to and movable relative to the wall of the connector body, the CPA device movable to place the first and second indicator features in the joined position.

In some implementations, the wall of the connector body that defines the first indicator feature is proximate to the mating interface, the CPA device being configured to engage the mating connector and to be moved by the mating connector in a joining direction relative to the wall of the connector body as the connector body is being mated to the mating connector such that the CPA device movable to place the first and second indicator features in the joined position when the connector body is fully mated to the mating connector. In some implementations, the CPA device is held in a track between two rails on the wall of the connector body, the CPA device including a deflectable latch extending from a first end of the CPA device, the deflectable latch engaging at least one of the rails to restrict movement of the CPA device in to the joined position when the connector body is not fully mated to the mating connector, the deflectable latch configured to be deflected by at least one corresponding lug of the mating connector as the connector body is being mated to the mating connector to allow the CPA device to be moved relative to the rails to the joined position.

In some implementations, the CPA device and the connector body include features configured to inhibit movement of the CPA device relative to the connector body when the first and second indicator features are in the joined position. In some implementations, locking features on the CPA device are in an interference fit with the connector body when the first and second indicator features are in the joined position. In some implementations, the CPA device defines compression ribs configured to inhibit lateral and longitudinal movement of the CPA device relative to the connector body when the first and second indicator features are in the joined position.

According to another aspect of the present disclosure, an electrical connector having recordable position assurance is presented. In one exemplary implementation, the electrical connector comprises: a connector body having a mating interface configured to engage a complementary mating connector during a mating operation having a first indicator feature, the first indicator feature having a first partial visual identifier disposed thereon, a CPA device having a second indicator feature, the second indicator feature having a second partial visual identifier disposed thereon, the CPA device coupled to the connector body, the CPA device movable relative to the connector body between a pre-staged position and a staged position, the CPA device disposed in the pre-staged position and restricted from moving to the staged position when the electrical connector is not fully mated to the mating connector, the CPA device configured to movable from the pre-staged position to the staged position responsive to the electrical connector being fully mated to the mating connector, characterized in that the first and second indicator feature form a complete visual identifier selected from a list consisting of a one-dimensional barcode, a two-dimensional barcode, and a three-dimensional barcode only when the CPA device is in the staged position, wherein the CPA device is in the pre-staged position when the connector body is not fully mated relative to the mating connector, and wherein the CPA device is in the staged position responsive to the connector body being fully mated to the mating connector.

In some implementations, the complete visual identifier identifies the electrical connector, the complete visual identifier being machine-readable such that the complete visual identifier is able to be read by a sensor only when the CPA device is in the staged position. In some implementations, the CPA device is held in a track between two rails on a wall of the connector body, the CPA device including a deflectable latch extending from a first end of the CPA device, the deflectable latch engaging at least one of the rails to restrict movement of the CPA device in to the staged position when the connector body is not fully mated to the mating connector, the deflectable latch configured to be deflected by at least one corresponding lug of the mating connector as the connector body is being mated to the mating connector to allow the CPA device to be moved relative to the rails to the staged position.

In some implementations, the CPA device and the connector body include features configured to inhibit movement of the CPA device relative to the connector body when the CPA device is in the staged position. In some implementations, locking features on the CPA device are in an interference fit with the connector body when the CPA device is in the staged position. In some implementations, the CPA device defines compression ribs configured to inhibit lateral and longitudinal movement of the CPA device relative to the connector body when the CPA device is in the staged position.

According to yet another aspect of the present disclosure, a method of mating a connector to a complementary mating connector is presented. In one exemplary implementation, the method comprises: providing the connector, the connector comprising a connector body having a mating interface configured to engage the complementary mating connector during a mating operation, a first indicator feature carried by the connector body, the first indicator feature having a first partial visual identifier disposed thereon, and a second indicator feature carried by the connector body having a second partial visual identifier disposed thereon, wherein the first and second indicator features are movable relative to each other between a separated position and a joined position, characterized in that the first and second indicator feature form a complete visual identifier selected from a list consisting of a one-dimensional barcode, a two-dimensional barcode, and a three-dimensional barcode only when in the joined position, wherein the first and second indicator features are in the separated position when the connector body is not fully mated relative to the mating connector, and wherein the first and second indicator features are in the joined position responsive to the connector body being fully mated to the mating connector, and identifying the connector using the complete visual identifier upon the first and second indicator features being in the joined position when the connector body is fully mated to the mating connector.

In some implementations, the identifying comprises machine-readable identification such that the complete visual identifier is able to be read by a sensor only when the first and second indicator features are in the joined position. In some implementations, a wall of the connector body defines the first indicator feature, the first partial visual identifier is disposed on an outer surface of the wall, the second indicator feature being a CPA device on which the second partial visual identifier is disposed that is coupled to and movable relative to the wall of the connector body, and the method further comprises moving the CPA device during the mating operation to place the first and second indicator features in the joined position.

In some implementations, the wall of the connector body that defines the first indicator feature is proximate to the mating interface, the CPA device being configured to engage the mating connector and to be moved by the mating connector in a joining direction relative to the wall of the connector body as the connector body is being mated to the mating connector such that the CPA device movable to place the first and second indicator features in the joined position when the connector body is fully mated to the mating connector.

In some implementations, the CPA device is held in a track between two rails on the wall of the connector body, the CPA device including a deflectable latch extending from a first end of the CPA device, the deflectable latch engaging at least one of the rails to restrict movement of the CPA device in to the joined position when the connector body is not fully mated to the mating connector, the deflectable latch configured to be deflected by at least one corresponding lug of the mating connector as the connector body is being mated to the mating connector to allow the CPA device to be moved relative to the rails to the joined position. In some implementations, the CPA device and the connector body include features configured to inhibit movement of the CPA device relative to the connector body when the first and second indicator features are in the joined position.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
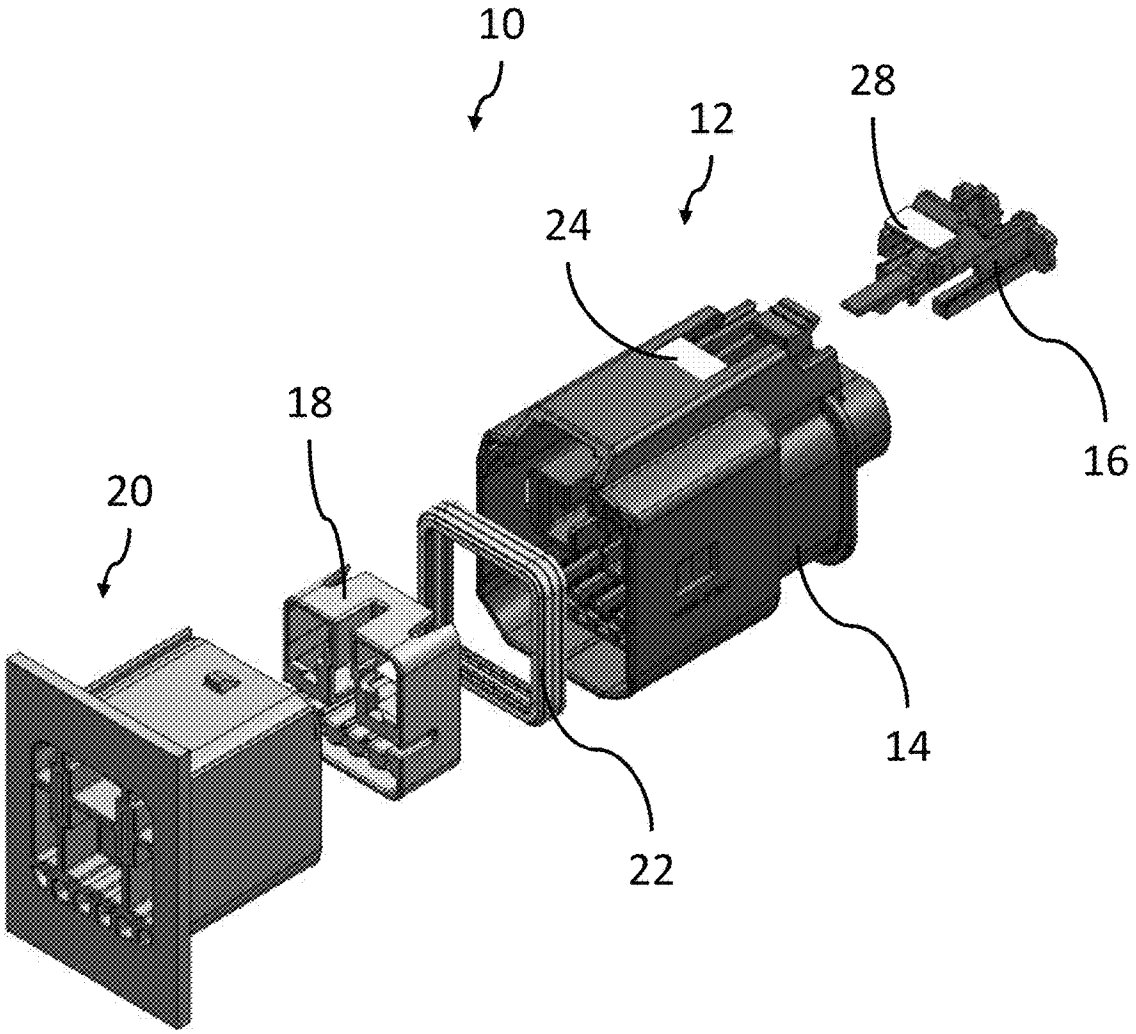
FIG. 1 is an exploded view of a connector assembly according to an embodiment of the disclosure.

FIGS. 1-8 illustrate an example embodiment of an electrical connector assembly, hereinafter referred to as the assembly 10. As shown in FIG. 1, the assembly 10 includes a first connector 12 having a connector body 14, a connector position assurance (CPA) device 16, a terminal retainer 18 configured to secure electrical terminals (not shown) within the connector body 14, and a complementary mating second connector 20 containing mating electrical terminals (not shown). The first connector 12 in this example also includes a seal 22 for sealing the first connector 12 to the second connector 20 to inhibit entry of environmental contaminants into the interface between the connectors.

Figure 3:
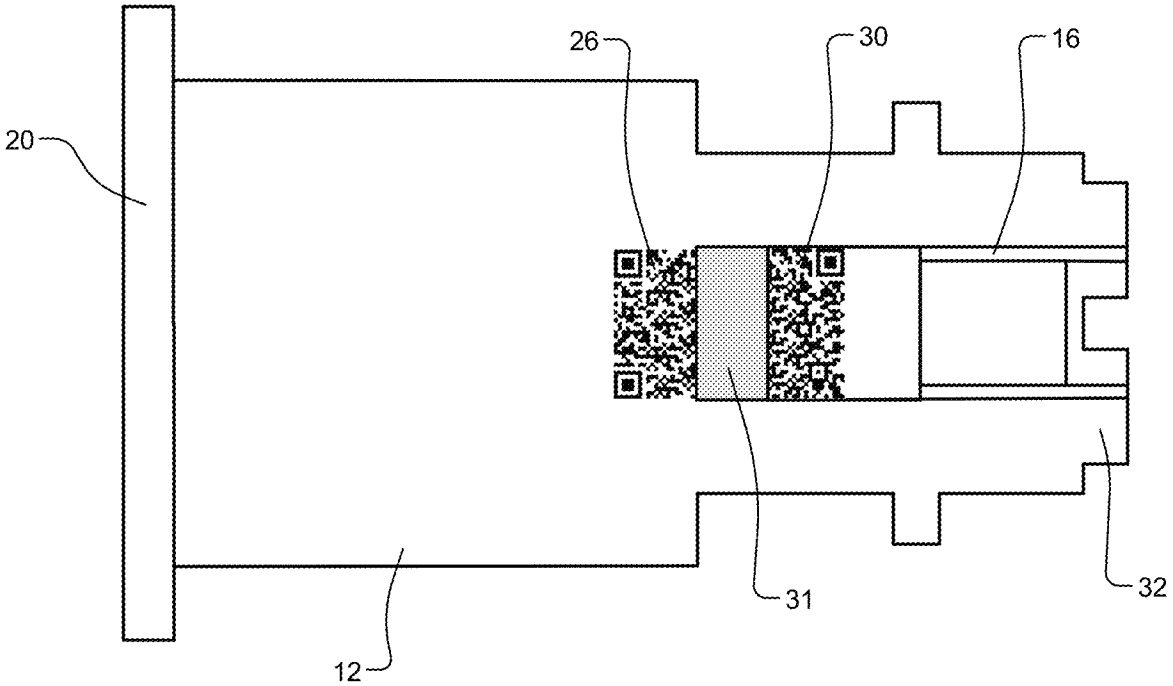
FIG. 3 is another top view of the connector assembly of FIG. 1 in the prestaged position according to an embodiment of the disclosure.

The first and second connectors are configured to be mated to one another during a manufacturing or assembly process. It may be useful to record that the first and second connectors are mated, such as to track progress during the manufacturing or assembly process and for verification if a question or issue arises later regarding whether first and second connectors were properly mated. In this example, the first connector 12 includes a first indicator feature 24 carried by the connector body 14 having a first partial visual identifier 26 (as best shown in FIG. 3) disposed thereon. The first connector 12 also includes a second indicator feature 28 carried by the connector body 14, in this example disposed on the CPA device 16 having a second partial visual identifier 30 (as best shown in FIG. 3) disposed thereon. As used herein, a respective feature being "carried by the connector body" means that the feature is either an integral component of the connector body 14; disposed on, in, or through the connector body 14; or coupled directly or indirectly to the connector body 14, such that movement of the connector body 14 moves the "carried" features as well.

Figure 2:
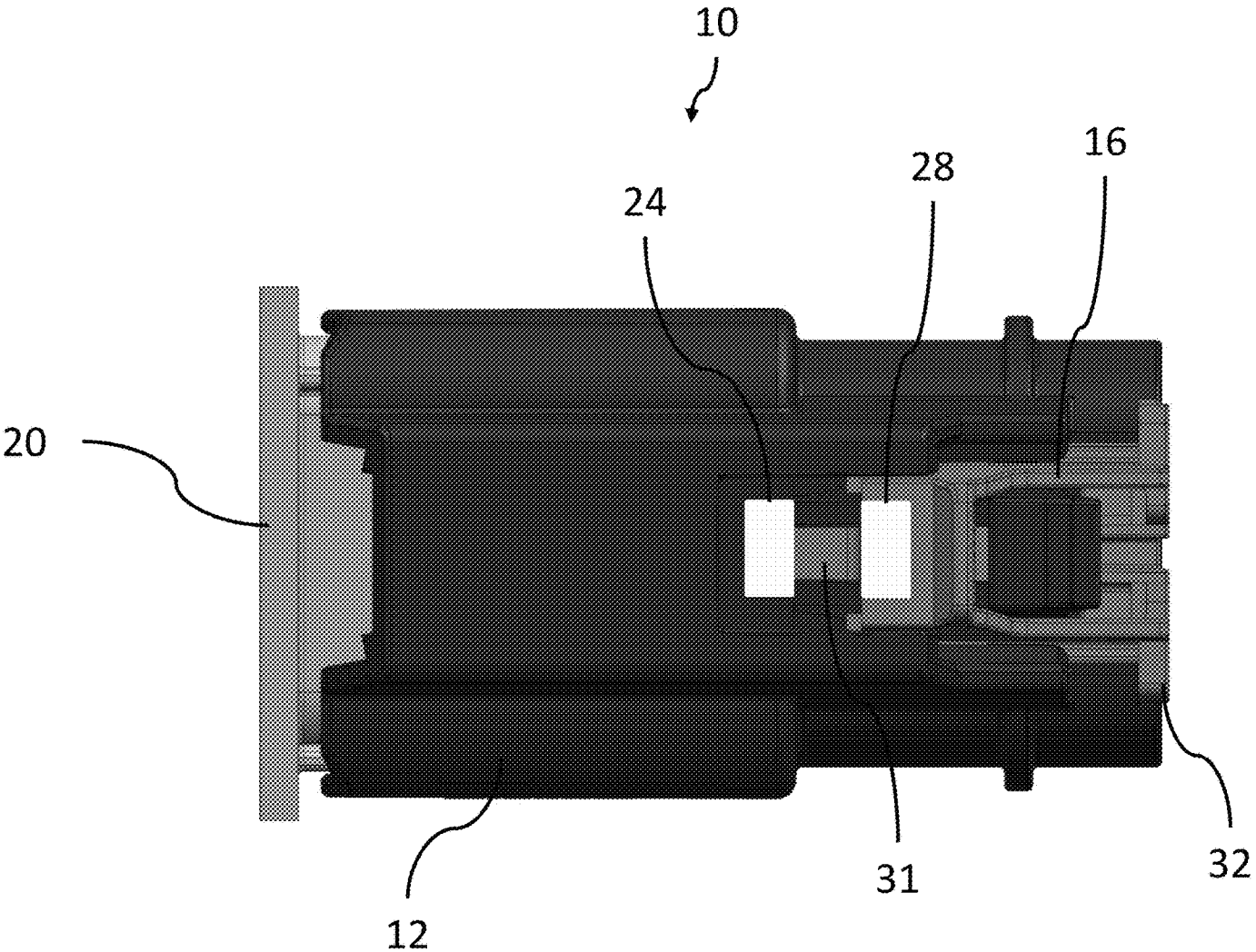
FIG. 2 is a top view of the connector assembly of FIG. 1 in a prestaged position according to an embodiment of the disclosure.
Figure 4:
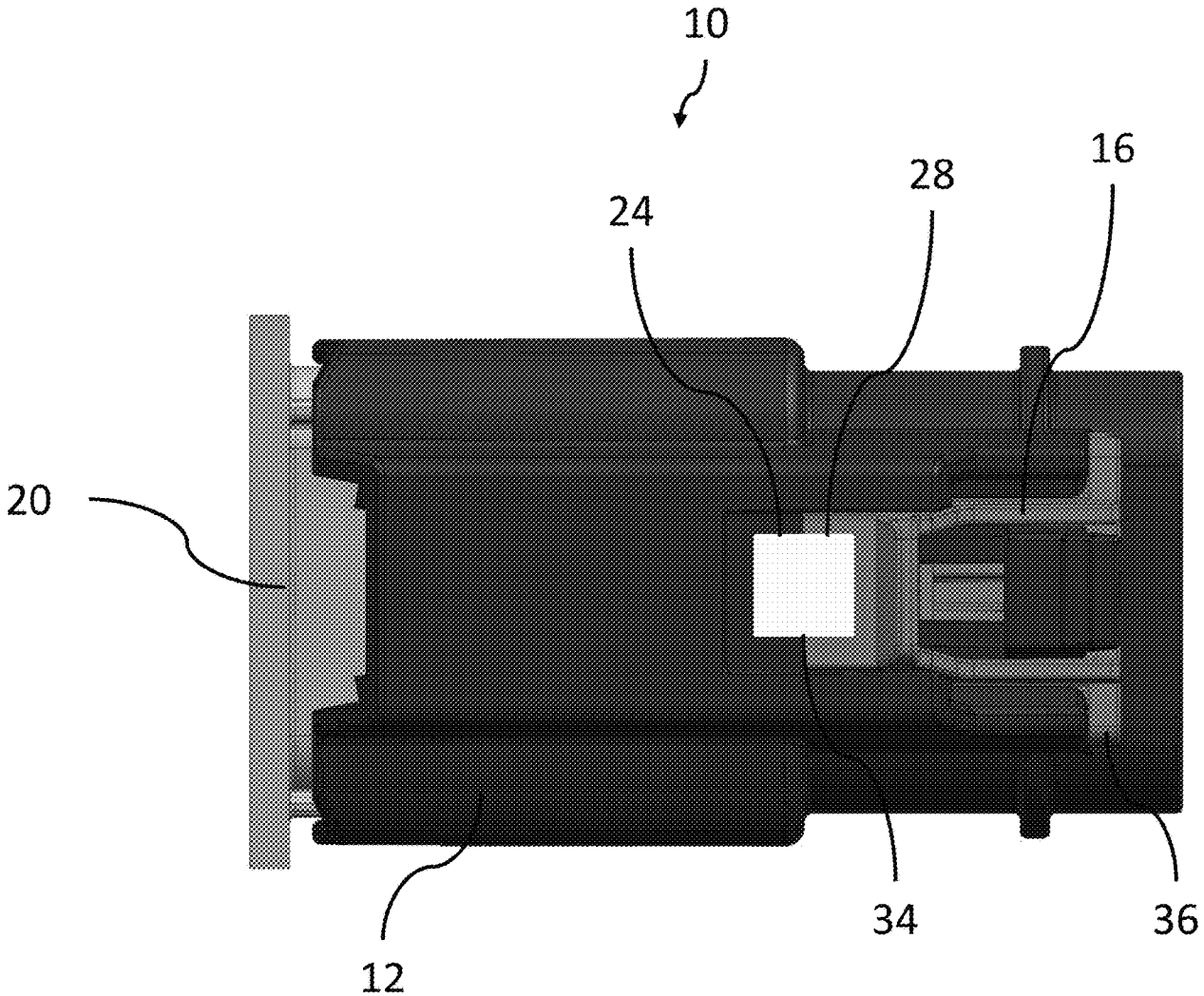
FIG. 4 is a top view of the connector assembly of FIG. 1 in a staged position according to an embodiment of the disclosure.
Figure 5:
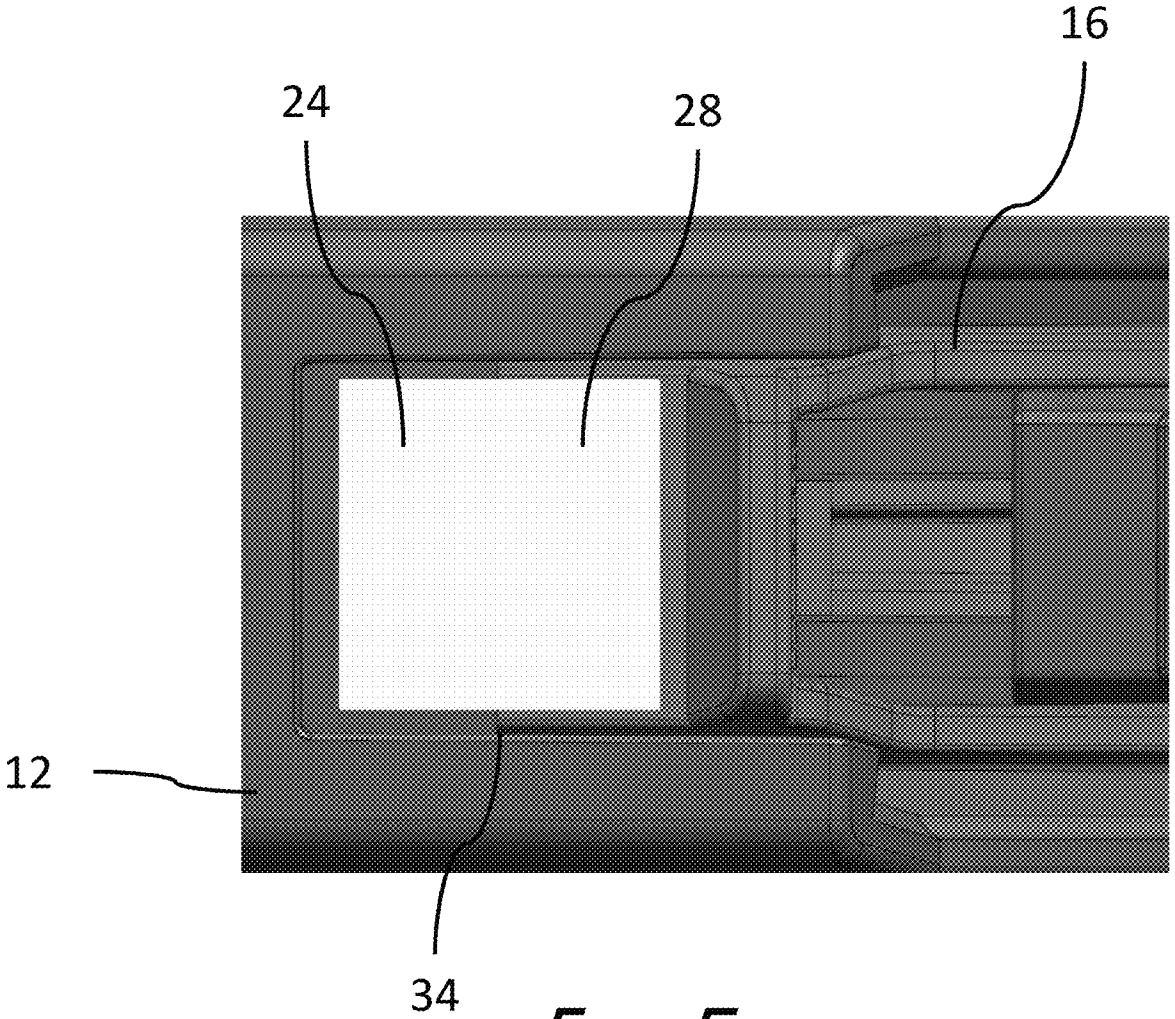
FIG. 5 is a close-up top view of a connector position assurance device and a connector body of the connector assembly of FIG. 1 in the staged position according to an embodiment of the disclosure.
Figure 6:
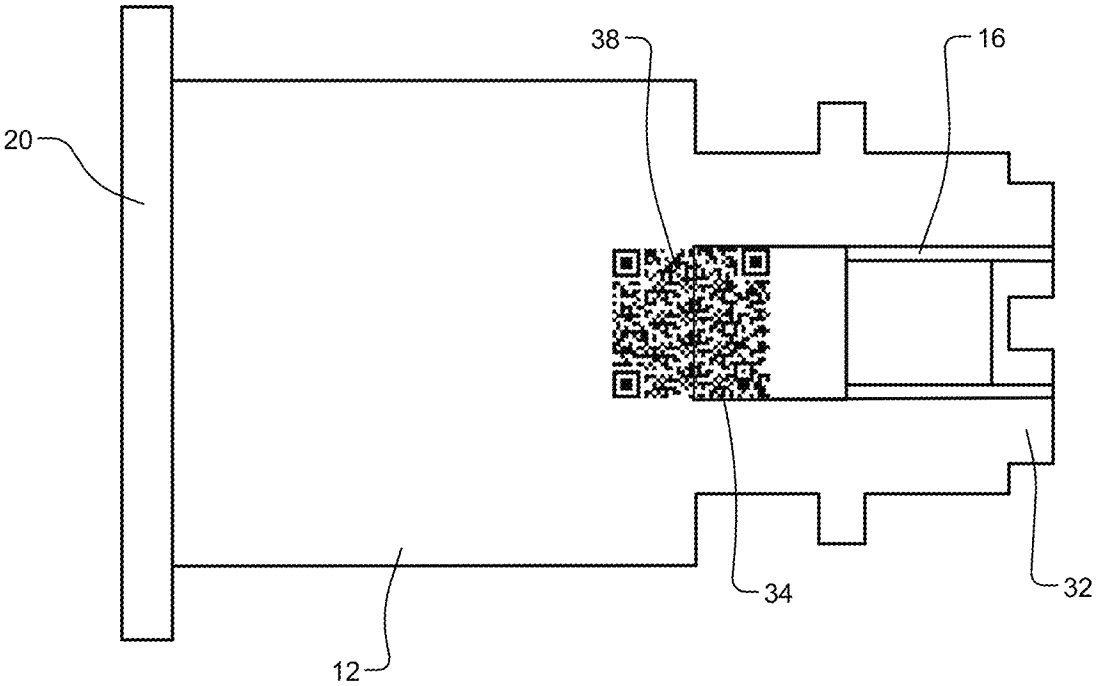
FIG. 6 is another top view of the connector assembly of FIG. 1 in the staged position according to an embodiment of the disclosure.

As shown in FIGS. 2 and 4, the first and second indicator features 24, 28 are movable relative to each other between a separated position 31 when the CPA device 16 is in its pre-staged position 32 and a joined position 34 when the CPA device 16 is in its staged position 36. The first and second indicator features 24, 28 form a complete visual identifier 38 when the first and second partial visual identifiers 26, 30 are adjacent one another when the first and second indicator features 24, 28 in the joined position 34.

The complete visual identifier 38 is associated with the respective first connector 12. For example, the complete visual identifier 38 may identify the first connector 12, such as via a part number. The complete visual identifier 38 may also be associated with the second connector 20, such as by identifying the second connector 20 to which the first connector 12 is configured to mate or by identifying the broader electrical connector system. The complete visual identifier 38 further may be associated with a larger machine or apparatus in which the first connector 12 is a component thereof, such as a specific type or model of automobile or appliance. Alternatively, the complete visual identifier 38 may uniquely identify the first connector 12, e.g. by a serial number of the first connector 12 or a Vehicle Identification Number (VIN) number of the automobile into which the first connector 12 is being assembled.

The complete visual identifier 38 may be a machine-readable one-dimensional barcode, a two-dimensional barcode, and a three-dimensional barcode. It also may be alphanumeric or symbolic indicia readable by a human or a machine.

The first and second indicator features 24, 28 are in the separated position 31 when the first connector 12 is not fully mated relative to the second connector 20 and the first and second indicator features 24, 28 are in the joined position 34 when to the first connector 12 is fully mated to the second connector 20. The first and second partial visual identifiers 26, 30 do not provide a machine-readable barcode or complete alphanumeric or symbolic indicia until they are adjacent one another, thereby forming the complete visual identifier 38.

The complete visual identifier 38 is machine-readable such that the complete visual identifier 38 is able to be read by a sensor only when the first and second indicator features 24, 28 are in the joined position 34. The first and second partial visual identifiers 26, 30 may not be properly read by a sensor when the first and second indicator features 24, 28 are in the separated position 31.

The sensor may be a handheld or mounted barcode scanner. The sensor may include a light source and a photodetector to read the complete visual identifier 38. Optionally, the sensor may include a digital camera. The sensor may be communicatively coupled to a database such that data obtained by the sensor is transmitted to the database for storage. The database may be located on a tangible and non-transitory computer readable storage device. The storage device may be a computer memory, such as a Random-Access Memory (RAM) or a hard disk drive, or the storage device may be a removable storage drive, such as a solid-state device, an optical drive, an external hard drive, a flash drive, or the like. The database may be accessible remotely from the sensor and at subsequent times in order to access information about the connector assembly 10 and/or the automobile, appliance, or other machine or device into which the connector assembly 10 is installed. For example, by recording the information contained in the complete visual identifier 38 in the database, the database may be accessed remotely and/or at a subsequent date and time to verify that the first connector 12 has been properly mated to the second connector 20.

As shown in FIGS. 2 to 5, a wall of the connector body 14 of the first connector 12 defines the first indicator feature 24. The first partial visual identifier 26 is located on an outer surface of the wall. The second indicator feature 28 is on the CPA device 16 on which the second partial visual identifier 30 is disposed. The first and second indicator features 24, 28 may be printed, painted, etched, or otherwise formed directly on the connector body 14 or CPA device 16. Alternatively, the first and second indicator features 24, 28 may be formed on a sticker, film, or the like, and subsequently bonded or otherwise attached to the connector body 14 or CPA device 16. The CPA device 16 is coupled to and movable relative to the wall of the connector body 14. The CPA device 16 is movable to place the first and second indicator features 24, 28 from the separated position 31 to the joined position 34 as the CPA device 16 moves from the pre-staged position 32 to the staged position 36.

The wall of the connector body 14 that defines the first indicator feature 24 is proximate to the mating interface. The CPA device 16 is configured to engage the second connector 20 and is configured to be moved by the second connector 20 in a joining direction relative to the wall of the connector body 14 as the first connector 12 is mated to the second connector 20 such that the CPA device 16 places the first and second indicator features 24, 28 in the joined position 34 when the first connector 12 is fully mated to the second connector 20.

The CPA device 16 is held in a track between two rails 42 on the wall of the connector body 14. The CPA device 16 includes a deflectable latch extending from a first end of the CPA device 16. The deflectable latch engages at least one of the rails 42 to restrict movement of the CPA device 16 to the pre-staged position 32 when the first connector 12 is not fully mated to the second connector 20. The deflectable latch is configured to be deflected by a corresponding lug of the second connector 20 as the first connector 12 is mated to the second connector 20 to allow the CPA device 16 to be moved relative to the rails 42 to the staged position 36.

Figures 7A, 7B:
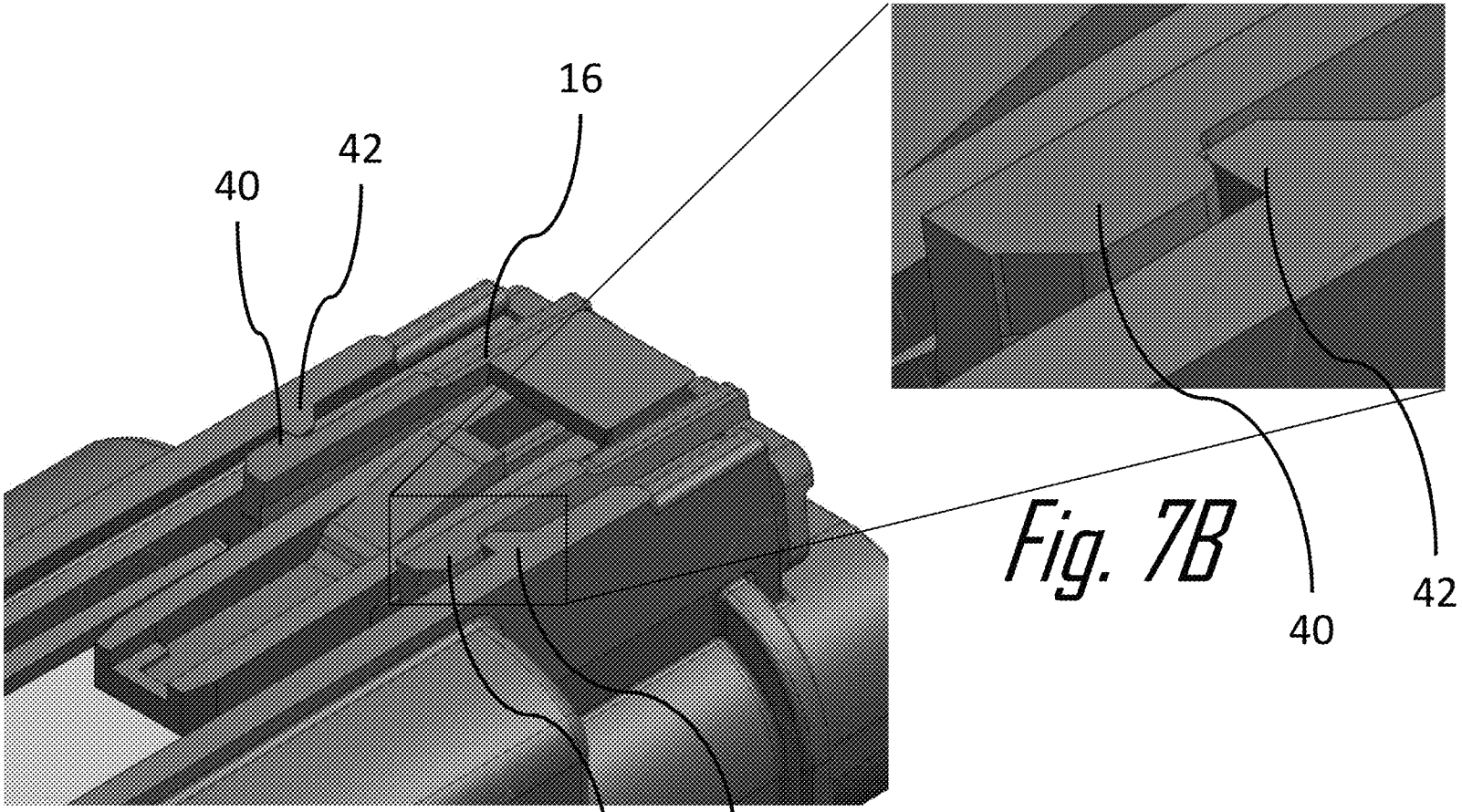
FIG. 7A is a cross section view of the connector assembly of FIG. 1 showing a connector position assurance device and a connector body of the connector assembly of FIG. 1 according to an embodiment of the disclosure.
FIG. 7B is an isolated cross section view of FIG. 7A showing an interference fit between the connector position assurance device and the connector body according to an embodiment of the disclosure.
Figure 8:
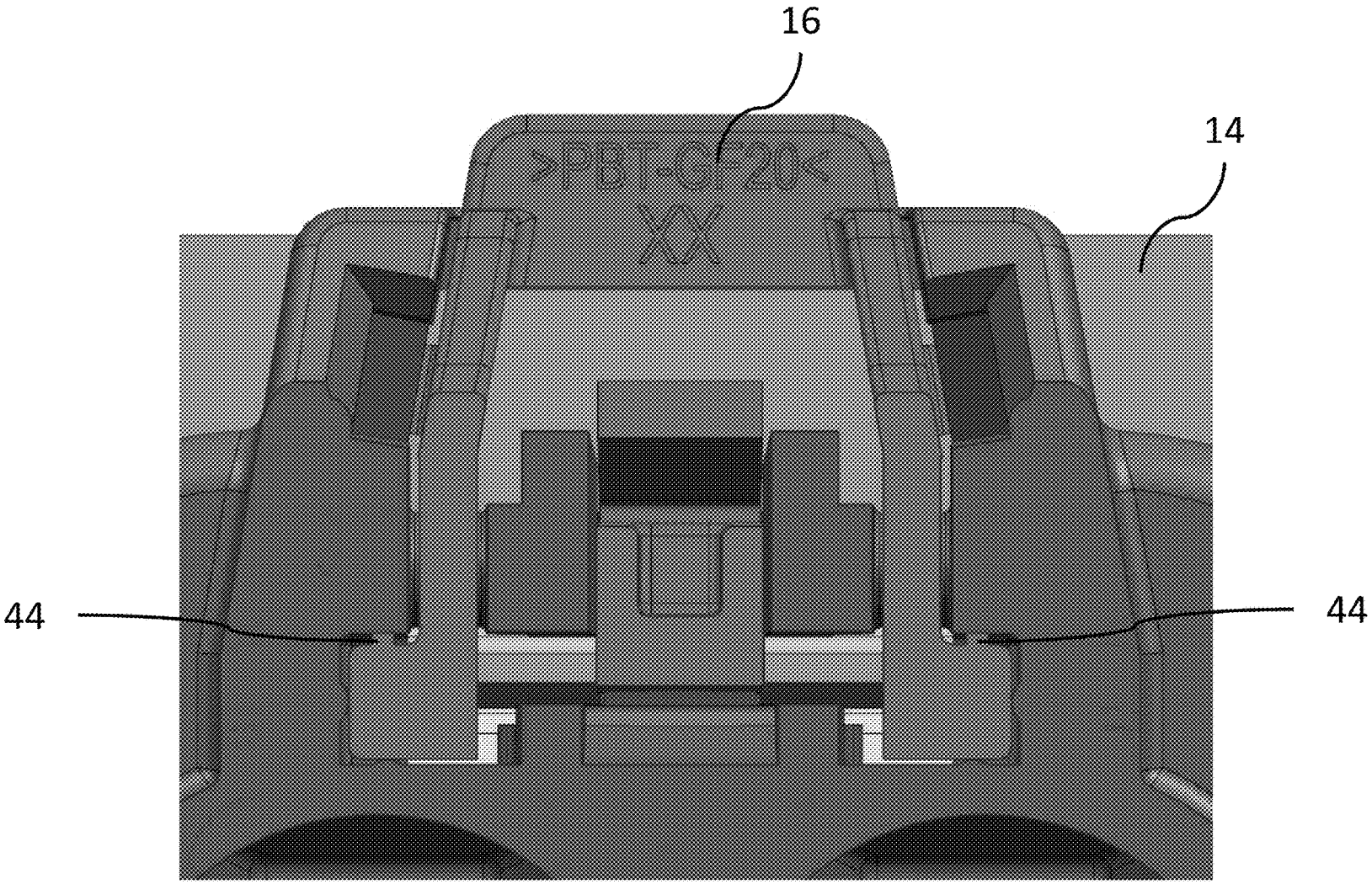
FIG. 8 is an alternate cross section view of the connector assembly of FIG. 1 showing ribs on the connector position assurance device in an inference fit with the connector body of the connector assembly of FIG. 1 according to an embodiment of the disclosure.

As shown in FIGS. 7A and 7B, locking features 40 on the CPA device 16 are in an interference fit with rails 42 on the connector body 14 when the first and second indicator features 24, 28 are in the joined position 34. As shown in FIG. 8, the CPA device 16 defines compression ribs 44 configured to inhibit lateral and longitudinal movement of the CPA device 16 relative to the connector body 14 when the first and second indicator features 24, 28 are in the joined position 34.

While the illustrated embodiment has an in-line CPA device 16, other embodiments of the disclosure may be envisioned in which the first connector includes a lever device to mate with the second connector and the first and second indicator features may be disposed on the lever and CPA device on the lever device.

Additionally, while the exemplary embodiment is an electrical connector, other embodiments may be envisioned that are adapted for use with fiber optic cables, pneumatic tubes, hydraulic tubes, or a hybrid connector assembly including two or more of the items listed above Accordingly, a connector assembly 10 with a connector position assurance indicator is provided. Two separate parts 24, 28 of an indicator feature 38, e.g. a machine-readable barcode is disposed on several components 14, 16 of the connector 12 that are separated by a gap until the connector 12 is properly mated with the mating connector 20. When the connectors are properly mated, the gap is closed and the barcode may be properly read by a sensor, such as a barcode scanner.

The indicator feature is always visible and does not require any part of the indicator feature to be covered or concealed. This provides flexibility in where the indicator feature may be located on the connector assembly. The indicator feature may be on any moveable feature on the connector assembly and is not limited to a CPA device connector body combination.

Although the present disclosure is not so limited, the following numbered examples demonstrate one or more aspects of the disclosure.

Example 1

A connector (12), comprising: a connector body (14) having a mating interface configured to engage a complementary mating connector (20) during a mating operation; a first indicator feature (24) carried by the connector body (14), the first indicator feature (24) having a first partial visual identifier (26) disposed thereon; and a second indicator feature (28) carried by the connector body (14) having a second partial visual identifier (30) disposed thereon, wherein the first and second indicator features (24, 28) are movable relative to each other between a separated position (30) and a joined position (34), characterized in that the first and second indicator feature (28) form a complete visual identifier (38) selected from a list consisting of a one-dimensional barcode, a two-dimensional barcode, and a three-dimensional barcode only when in the joined position (34), wherein the first and second indicator features (24, 28) are in the separated position (30) when the connector body (14) is not fully mated relative to the mating connector (20), and wherein the first and second indicator features (24, 28) are in the joined position (34) responsive to the connector body (14) being fully mated to the mating connector (20).

Example 2

The connector (12) in accordance with example 1, wherein the complete visual identifier (38) identifies the connector (12), the complete visual identifier (38) being machine-readable such that the complete visual identifier (38) is able to be read by a sensor only when the first and second indicator features (24, 28) are in the joined position (34).

Example 3

The connector (12) in accordance with example 1 or 2, wherein a wall of the connector body (14) defines the first indicator feature (24), the first partial visual identifier (26) is disposed on an outer surface of the wall, the second indicator feature (28) being a connector (12) position assurance (CPA) device (16) on which the second partial visual identifier (30) is disposed that is coupled to and movable relative to the wall of the connector body (14), the CPA device (16) movable to place the first and second indicator features (24, 28) in the joined position (34).

Example 4

The connector (12) in accordance with example 3, wherein the wall of the connector body (14) that defines the first indicator feature (24) is proximate to the mating interface, the CPA device (16) being configured to engage the mating connector (20) and to be moved by the mating connector (20) in a joining direction relative to the wall of the connector body (14) as the connector body (14) is being mated to the mating connector (20) such that the CPA device (16) movable to place the first and second indicator features (24, 28) in the joined position (34) when the connector body (14) is fully mated to the mating connector (20).

Example 5

The connector (12) in accordance with example 3, wherein the CPA device (16) is held in a track between two rails (42) on the wall of the connector body (14), the CPA device (16) including a deflectable latch extending from a first end of the CPA device (16), the deflectable latch engaging at least one of the rails (42) to restrict movement of the CPA device (16) in to the joined position (34) when the connector body (14) is not fully mated to the mating connector (20), the deflectable latch configured to be deflected by at least one corresponding lug of the mating connector (20) as the connector body (14) is being mated to the mating connector (20) to allow the CPA device (16) to be moved relative to the rails (42) to the joined position (34).

Example 6

The connector (12) in accordance with any one of examples 1 to 5, wherein the CPA device (16) and the connector body (14) include features configured to inhibit movement of the CPA device (16) relative to the connector body (14) when the first and second indicator features (24, 28) are in the joined position (34).

Example 7

The connector (12) in accordance with example 6, wherein locking features (40) on the CPA device (16) are in an interference fit with the connector body (14) when the first and second indicator features (24, 28) are in the joined position (34).

Example 8

The connector (12) in accordance with example 6, wherein the CPA device (16) defines compression ribs (44) configured to inhibit lateral and longitudinal movement of the CPA device (16) relative to the connector body (14) when the first and second indicator features (24, 28) are in the joined position (34).

Example 9

An electrical connector (12) having recordable position assurance, the electrical connector (12) comprising: a connector body (14) having a mating interface configured to engage a complementary mating connector (20) during a mating operation having a first indicator feature (24), the first indicator feature (24) having a first partial visual identifier (26) disposed thereon; a connector (12) position assurance (CPA) device (16) having a second indicator feature (28), the second indicator feature (28) having a second partial visual identifier (30) disposed thereon, the CPA device (16) coupled to the connector body (14), the CPA device (16) movable relative to the connector body (14) between a pre-staged position (32) and a staged position (36), the CPA device (16) disposed in the pre-staged position (32) and restricted from moving to the staged position (36) when the electrical connector (12) is not fully mated to the mating connector (20), the CPA device (16) configured to movable from the pre-staged position (32) to the staged position (36) responsive to the electrical connector (12) being fully mated to the mating connector (20), characterized in that the first and second indicator feature (28) form a complete visual identifier (38) selected from a list consisting of a one-dimensional barcode, a two-dimensional barcode, and a three-dimensional barcode only when the CPA device (16) is in the staged position (36), wherein the CPA device (16) is in the pre-staged position (32) when the connector body (14) is not fully mated relative to the mating connector (20), and wherein the CPA device (16) is in the staged position (36) responsive to the connector body (14) being fully mated to the mating connector (20).

Example 10

The electrical connector (12) in accordance with example 9, wherein the complete visual identifier (38) identifies the electrical connector (12), the complete visual identifier (38) being machine-readable such that the complete visual identifier (38) is able to be read by a sensor only when the CPA device (16) is in the staged position (36).

Example 11

The electrical connector (12) in accordance with example 9 or 10, wherein the CPA device (16) is held in a track between two rails (42) on a wall of the connector body (14), the CPA device (16) including a deflectable latch extending from a first end of the CPA device (16), the deflectable latch engaging at least one of the rails (42) to restrict movement of the CPA device (16) in to the staged position (36) when the connector body (14) is not fully mated to the mating connector (20), the deflectable latch configured to be deflected by at least one corresponding lug of the mating connector (20) as the connector body (14) is being mated to the mating connector (20) to allow the CPA device (16) to be moved relative to the rails (42) to the staged position (36).

Example 12

The electrical connector (12) in accordance with any one of the examples 9 to 11, wherein the CPA device (16) and the connector body (14) include features configured to inhibit movement of the CPA device (16) relative to the connector body (14) when the CPA device (16) is in the staged position (36).

Example 13

The electrical connector (12) in accordance with example 12, wherein locking features (40) on the CPA device (16) are in an interference fit with the connector body (14) when the CPA device (16) is in the staged position (36).

Example 14

The electrical connector (12) in accordance with example 12, wherein the CPA device (16) defines compression ribs (44) configured to inhibit lateral and longitudinal movement of the CPA device (16) relative to the connector body (14) when the CPA device (16) is in the staged position (36).

While this disclosure has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the disclosure without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the disclosure should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

What is claimed is:

1. A connector, comprising:

a connector body having a mating interface configured to engage a complementary mating connector during a mating operation;

a first indicator feature carried by the connector body, the first indicator feature having a first partial visual identifier disposed thereon; and a second indicator feature carried by the connector body having a second partial visual identifier disposed thereon, wherein the first and second indicator features are movable relative to each other between a separated position and a joined position, characterized in that the first and second indicator feature form a complete visual identifier selected from a list consisting of a one-dimensional barcode, a two-dimensional barcode, and a three-dimensional barcode only when in the joined position, wherein the first and second indicator features are in the separated position when the connector body is not fully mated relative to the mating connector, and wherein the first and second indicator features are in the joined position responsive to the connector body being fully mated to the mating connector.

2. The connector of claim 1, wherein the complete visual identifier identifies the connector, the complete visual identifier being machine-readable such that the complete visual identifier is able to be read by a sensor only when the first and second indicator features are in the joined position.

3. The connector of claim 1, wherein a wall of the connector body defines the first indicator feature, the first partial visual identifier is disposed on an outer surface of the wall, the second indicator feature being a connector position assurance (CPA) device on which the second partial visual identifier is disposed that is coupled to and movable relative to the wall of the connector body, the CPA device movable to place the first and second indicator features in the joined position.

4. The connector of claim 3, wherein the wall of the connector body that defines the first indicator feature is proximate to the mating interface, the CPA device being configured to engage the mating connector and to be moved by the mating connector in a joining direction relative to the wall of the connector body as the connector body is being mated to the mating connector such that the CPA device movable to place the first and second indicator features in the joined position when the connector body is fully mated to the mating connector.

5. The connector of claim 3, wherein the CPA device is held in a track between two rails on the wall of the connector body, the CPA device including a deflectable latch extending from a first end of the CPA device, the deflectable latch engaging at least one of the rails to restrict movement of the CPA device in to the joined position when the connector body is not fully mated to the mating connector, the deflectable latch configured to be deflected by at least one corresponding lug of the mating connector as the connector body is being mated to the mating connector to allow the CPA device to be moved relative to the rails to the joined position.

6. The connector of claim 3, wherein the CPA device and the connector body include features configured to inhibit movement of the CPA device relative to the connector body when the first and second indicator features are in the joined position.

7. The connector of claim 6, wherein locking features on the CPA device are in an interference fit with the connector body when the first and second indicator features are in the joined position.

8. The connector of claim 6, wherein the CPA device defines compression ribs configured to inhibit lateral and longitudinal movement of the CPA device relative to the connector body when the first and second indicator features are in the joined position.

9. An electrical connector having recordable position assurance, the electrical connector comprising:

a connector body having a mating interface configured to engage a complementary mating connector during a mating operation having a first indicator feature, the first indicator feature having a first partial visual identifier disposed thereon; and a connector position assurance (CPA) device having a second indicator feature, the second indicator feature having a second partial visual identifier disposed thereon, the CPA device coupled to the connector body, the CPA device movable relative to the connector body between a pre-staged position and a staged position, the CPA device disposed in the pre-staged position and restricted from moving to the staged position when the electrical connector is not fully mated to the mating connector, the CPA device configured to movable from the pre-staged position to the staged position responsive to the electrical connector being fully mated to the mating connector, characterized in that the first and second indicator feature form a complete visual identifier selected from a list consisting of a one-dimensional barcode, a two-dimensional barcode, and a three-dimensional barcode only when the CPA device is in the staged position, wherein the CPA device is in the pre-staged position when the connector body is not fully mated relative to the mating connector, and wherein the CPA device is in the staged position responsive to the connector body being fully mated to the mating connector.

10. The electrical connector of claim 9, wherein the complete visual identifier identifies the electrical connector, the complete visual identifier being machine-readable such that the complete visual identifier is able to be read by a sensor only when the CPA device is in the staged position.

11. The electrical connector of claim 9, wherein the CPA device is held in a track between two rails on a wall of the connector body, the CPA device including a deflectable latch extending from a first end of the CPA device, the deflectable latch engaging at least one of the rails to restrict movement of the CPA device in to the staged position when the connector body is not fully mated to the mating connector, the deflectable latch configured to be deflected by at least one corresponding lug of the mating connector as the connector body is being mated to the mating connector to allow the CPA device to be moved relative to the rails to the staged position.

12. The electrical connector of claim 9, wherein the CPA device and the connector body include features configured to inhibit movement of the CPA device relative to the connector body when the CPA device is in the staged position.

13. The electrical connector of claim 12, wherein locking features on the CPA device are in an interference fit with the connector body when the CPA device is in the staged position.

14. The electrical connector of claim 12, wherein the CPA device defines compression ribs configured to inhibit lateral and longitudinal movement of the CPA device relative to the connector body when the CPA device is in the staged position.

15. A method of mating a connector to a complementary mating connector, the method comprising:

providing the connector, the connector comprising:

a connector body having a mating interface configured to engage the complementary mating connector during a mating operation;

a first indicator feature carried by the connector body, the first indicator feature having a first partial visual identifier disposed thereon; and a second indicator feature carried by the connector body having a second partial visual identifier disposed thereon, wherein the first and second indicator features are movable relative to each other between a separated position and a joined position, characterized in that the first and second indicator feature form a complete visual identifier selected from a list consisting of a one-dimensional barcode, a two-dimensional barcode, and a three-dimensional barcode only when in the joined position, wherein the first and second indicator features are in the separated position when the connector body is not fully mated relative to the mating connector, and wherein the first and second indicator features are in the joined position responsive to the connector body being fully mated to the mating connector; and identifying the connector using the complete visual identifier upon the first and second indicator features being in the joined position when the connector body is fully mated to the mating connector.

16. The method of claim 15, wherein the identifying comprises machine-readable identification such that the complete visual identifier is able to be read by a sensor only when the first and second indicator features are in the joined position.

17. The method of claim 16, wherein a wall of the connector body defines the first indicator feature, the first partial visual identifier is disposed on an outer surface of the wall, the second indicator feature being a connector position assurance (CPA) device on which the second partial visual identifier is disposed that is coupled to and movable relative to the wall of the connector body, and the method further comprises moving the CPA device during the mating operation to place the first and second indicator features in the joined position.

18. The method of claim 17, wherein the wall of the connector body that defines the first indicator feature is proximate to the mating interface, the CPA device being configured to engage the mating connector and to be moved by the mating connector in a joining direction relative to the wall of the connector body as the connector body is being mated to the mating connector such that the CPA device movable to place the first and second indicator features in the joined position when the connector body is fully mated to the mating connector.

19. The method of claim 17, wherein the CPA device is held in a track between two rails on the wall of the connector body, the CPA device including a deflectable latch extending from a first end of the CPA device, the deflectable latch engaging at least one of the rails to restrict movement of the CPA device in to the joined position when the connector body is not fully mated to the mating connector, the deflectable latch configured to be deflected by at least one corresponding lug of the mating connector as the connector body is being mated to the mating connector to allow the CPA device to be moved relative to the rails to the joined position.

20. The method of claim 17, wherein the CPA device and the connector body include features configured to inhibit movement of the CPA device relative to the connector body when the first and second indicator features are in the joined position.

* * * * *